United States Patent [19]

Breidegam et al.

[11] Patent Number: 4,974,115

[45] Date of Patent: Nov. 27, 1990

[54] IONIZATION SYSTEM

[75] Inventors: Albert C. Breidegam, Sharpsburg; C. James Corris, Shenandoah, both of Ga.; Frank J. McCarty, Lake Worth, Fla.

[73] Assignee: Semtronics Corporation, Peachtree City, Ga.

[21] Appl. No.: 265,789

[22] Filed: Nov. 1, 1988

[51] Int. Cl.[5] ..... H05F 3/04

[52] U.S. Cl. ..... 361/231; 361/213; 361/235

[58] Field of Search ..... 361/212-215, 361/229-235

[56] References Cited

U.S. PATENT DOCUMENTS

| | | | |
|---|---|---|---|
| 2,264,495 | 12/1941 | Wilner | 361/231 |
| 3,624,448 | 11/1971 | Saurenman | 361/231 |
| 3,711,743 | 1/1973 | Bolasny | 361/231 |
| 3,936,698 | 2/1976 | Meyer | 361/231 |
| 3,943,407 | 3/1976 | Bolasny | 361/229 |
| 4,092,543 | 5/1978 | Levy | 361/213 |
| 4,107,756 | 8/1978 | Best et al. | 361/231 |
| 4,216,518 | 8/1980 | Simons | 361/213 |
| 4,222,007 | 9/1980 | Comstock | 324/458 |
| 4,319,302 | 3/1982 | Moulden | 361/231 |
| 4,351,648 | 9/1982 | Penney | 55/137 |
| 4,476,514 | 10/1984 | Mykkanen | 361/229 |
| 4,517,143 | 5/1985 | Kisler | 361/213 |
| 4,528,612 | 7/1985 | Spengler | 361/231 |
| 4,529,940 | 7/1985 | Blitshteyn | 324/458 |
| 4,542,434 | 9/1985 | Gehlke et al. | 361/231 |
| 4,558,309 | 12/1985 | Antonevich | 340/649 |
| 4,757,421 | 7/1988 | Mykkanen | 361/235 |

OTHER PUBLICATIONS

U.S. patent application #581,421 filed 2/17/84 and issued on 9/17/85 on U.S. Pat. No. 4,524,434 to Gehlke et al.

Disclosure entitled "911 Heated Ionized Air Blower," (undated) (Static Control Systems/3M—2 pages).

D. Yenni, "Basic Electrical Considerations in the Design of a Static-Safe Work Environment" presented at 1979 Nepcon/West Conference, Anaheim, Calif. (Static Control Systems/3M—13 pages).

J. Huntsman, D. Yenni, "Charge Drainage vs Voltage Supression by Static Control Table Tops" reprinted from *Evaluation Engineering Magazine*, Mar. 1982 (Static Control Systems/3M—4 pages).

L. Herauf, "Measurement of Ion Distribution in Ionized Air," (undated) (Static Control Systems/3M—3 pages).

Brochure entitled "Ahhh hhhh hhhh.—Ionosphere T-M—The Ultimate Air Purifier," (undated) (Ion Systems, Inc., Berkeley, Calif.—1 page).

T. Turner, "Static in a Wafer Fabrication Facility: Causes and Solutions," *Semiconductor International*, Aug. 1983 (6 pages, including title page).

*Primary Examiner*—A. D. Pellinen
*Assistant Examiner*—Jeffrey A. Gaffin
*Attorney, Agent, or Firm*—Kilpatrick & Cody

[57] ABSTRACT

An area ionization system which includes a first set of positive emitters and a second set of negative emitters for providing a supply of positive and negative ions to a work area. A control circuit or computerized control system simultaneously provides high voltage to the positive emitters and to the negative emitters. This "steady state DC" system has been found to be superior to previous systems which provide alternating current or pulsed direct current to emitters. The steady, balanced supply of positive and negative ions allows faster charge decay rates within the work area as well as reduced foreign material contamination. The system also distributes power to the emitters throughout the work area via low voltage lines. The low voltage is stepped up in the emitter arrays in order to supply 8-12 kilovolts to the emitters. The lower voltage requirements as compared to alternating current and pulse direct current systems reduces production of harmful ozone, and the low voltage distribution system decreases conflicts with electrical code requirements. This system also allows the environmental history for products manufactured in the work area to be documented, including the following parameters: ionization, temperature, humidity, air flow, and ozone data.

20 Claims, 21 Drawing Sheets

PROGRAM INTERACTION

SYSTEM INITIAL POWER-UP

DATA ACQUISITION CONTROL FLOWCHART

PARAMETERS NEEDED IN SYS-GEN

ROOM IONIZER CONTROL SYS-GEN

TEMPERATURE MONITOR SYS-GEN

ION CURRENT SENSOR MONITOR SYS-GEN

FOOTWEAR TESTER MONITOR SYS-GEN

WRIST STRAP MONITOR SYS-GEN

HUMIDITY MONITOR SYS-GEN

AIR FLOW MONITOR SYS-GEN

TABLE TOP IONIZER MONITOR SYS-GEN

IONIZATION SYSTEM

The present invention provides area ionization systems that supply positive and negative ions to work areas. These systems simultaneously and continuously generate and supply positive and negative ions. The balanced supply of ions minimizes the possibility of harmful electrostatic discharge which can damage or destroy components that are manufactured or handled in such work areas. The ions also reduce electrostatic attraction, foreign material contamination and other undesirable effects of triboelectric charge generation and airborne particles.

BACKGROUND OF THE INVENTION

Room ionization systems typically feature a number of tungsten points or similar emitters which generate positively charged ions, negatively charged ions, or both. The ions produced by these emitters migrate to the work area and neutralize charges on objects in the work area.

The emitters generate ions when excited by high voltage energy. A centrally located control unit and power supply typically distributes high voltage electricity to the emitters through a network of high voltage conductors. The emitters are typically located overhead in or near the ceiling of the area, and a curtain of moving air provided by blowers helps transport the ions to the work area.

One typical area ionization system provides alternating current to the emitters. The emitters in such "AC" systems thus produce alternating waves of positive and negative ions. Another typical type of area ionization system provides successive pulses of DC voltage to the emitters. For instance, the emitters receive a first pulse of positive DC voltage followed by a pause when no voltage is supplied, followed by a pulse of negative DC voltage. The pulses may be of varying length and strength, and the pauses may be of varying length or omitted. Such "pulse DC" systems can thus approximate AC systems when the pulses are shaped and timed appropriately. The pulse DC systems accordingly also generate ion waves.

The AC and pulse DC ionization systems follow the conventional wisdom that positive and negative ions generated close to one another at the same time will attract each other and cancel themselves. Those systems thus seek to produce a sufficient number of ions of a first polarity and allow them to migrate sufficiently far from the emitters before switching polarity of the emitters to generate ions of the other polarity. Although a certain percentage of ions in successive oppositely polarized waves cancel each other, a supply of positive and negative ions does reach the workspace.

The ion waves produced by AC and pulse DC systems exhibit normal wave behavior, however. First, such waves of ions superimpose themselves on one another. Ion waves produced by a first emitter cooperate with ion waves produced by other emitters to add together not unlike waves which combine at the seashore. This superposition causes the work area to receive alternating concentrations of positive ions and then negative ions over time, rather than a simultaneous balanced supply of both ion types.

SUMMARY OF THE INVENTION

The area ionization systems of the present invention counter the conventional wisdom by simultaneously and continuously producing positive and negative ions. These "steady state DC" systems produce positive ions on a first set of emitters and negative ions on a second set which are energized contemporaneously with the first. The emitter sets may be conveniently located near each other, as on a common structural member. Although a certain number of oppositely polarized ions do attract and cancel one another, experiments and characterizations show that these systems provide an ample, continuous, steady and balanced supply of positive and negative ions to the work area.

The strength of the positive and negative direct current supply to the emitters may be independently or commonly adjusted to alter the amount of positive or negative ions, or both, supplied to the area, and the current may be interrupted as desired to change or maintain ionization levels in the area.

Steady state DC systems of the present invention furthermore utilize low voltage conductors to distribute power to the emitters. The control circuits provide power preferably at approximately 10–24 volts to step-up transformers located at the emitters. The step-up transformers increase the voltage to approximately eight to twelve kilovolts. The systems of the present invention thus avoid the need to install high voltage conductors through the work area in order to distribute high voltage power to the emitters. These systems thus reduce potential conflicts with electrical code requirements in many jurisdictions, among other benefits.

Experiments show that a simultaneous and continuous supply of positive and negative ions to the work area allows the area to reach a desired stable ionization level more quickly than AC or pulse DC techniques. The steady state DC systems also allow the work area to be maintained within far closer tolerances to the desired ionization level over extended periods of time. Such a system has, for instance, maintained the potential in a work area at zero volts plus or minus 15 volts for days at a time. The steady state DC systems also quickly and efficiently return the area to stable ionization levels when temperature or humidity changes, or introduction of persons or material into the area, disrupt ion balance and density.

The steady state DC systems also lend themselves well to automatic control. Sensors placed in the work area or in the emitter array area detect the net charge and thus the ionization level in the area and supply this feedback information to analog or digital control circuits. The circuits automatically adjust positive voltage or negative voltage to the emitters, and, when desired, interrupt the voltage to the emitters.

A computer used with the steady state DC systems of the present invention can easily receive feedback and control power to the emitters. An alternative embodiment of present invention features computer programs and hardware which allow the user to set desired ionization levels and ionization levels at which the system will provide warnings. The computer equipment controls the voltage applied to the emitters and acquires, stores and records information obtained from the sensors in the work area. Such sensors include not only the feedback sensors which control the steady state DC systems, but also other static electricity sensors such as wrist straps, footwear testers, charge build-up monitors, and other static electricity control equipment used in the work area as well as temperature, humidity, air flow and ozone sensors, among others. The user of the computerized system can thus document and provide an environmental history of the products produced or handled in the work area.

Steady state DC systems of the present invention have been shown in experiments to neutralize charged particles in work areas more quickly than AC or pulse DC systems. The steady state DC systems also eliminate space charging tendencies caused by the ion waves that are produced by AC or pulse DC systems. Furthermore, the steady state DC systems allow smaller foreign material counts in work areas than other systems. Foreign material settling count characteristics of the steady state DC systems also exceed those of AC and pulse DC systems according to such experiments. The steady state DC systems also create far less ozone than AC or pulse DC systems, because they operate at a lower voltage on the emitters.

It is therefore an object of the present invention to provide an area ionization system which creates a continuous and balanced supply of positive and negative ions in the work area quickly, dependably and within close tolerances.

It is an additional object of the present invention to provide an area ionization system which applies positive and negative voltage to a first and second set of emitters simultaneously and continuously.

It is an additional object of the present invention to provide an area ionization system which can easily be controlled by automatic monitoring and control circuits or computerized devices.

It is an additional object of the present invention to provide an area ionization system which documents the environmental history of products manufactured in the work area.

It is an additional object of the present invention to provide an area ionization system which monitors not only atmospheric ionization, but also static control wrist straps, footwear testers, ion current sensors, charge build-up monitors and temperature, humidity, air flow and ozone sensors within the area.

Other objects features and advantages of present invention will become apparent with reference to the remainder of this document.

BRIEF DESCRIPTION OF THE DRAWINGS

FIGS. 5A–D are flow diagrams of the initialization and monitoring programs shown in FIG. 4.

FIGS. 6A–K are flow diagrams for initialization routines for various sensors which may be utilized in area ionization systems of the present invention.

DETAILED DESCRIPTION OF THE DRAWINGS

Figures 1A, 1B:
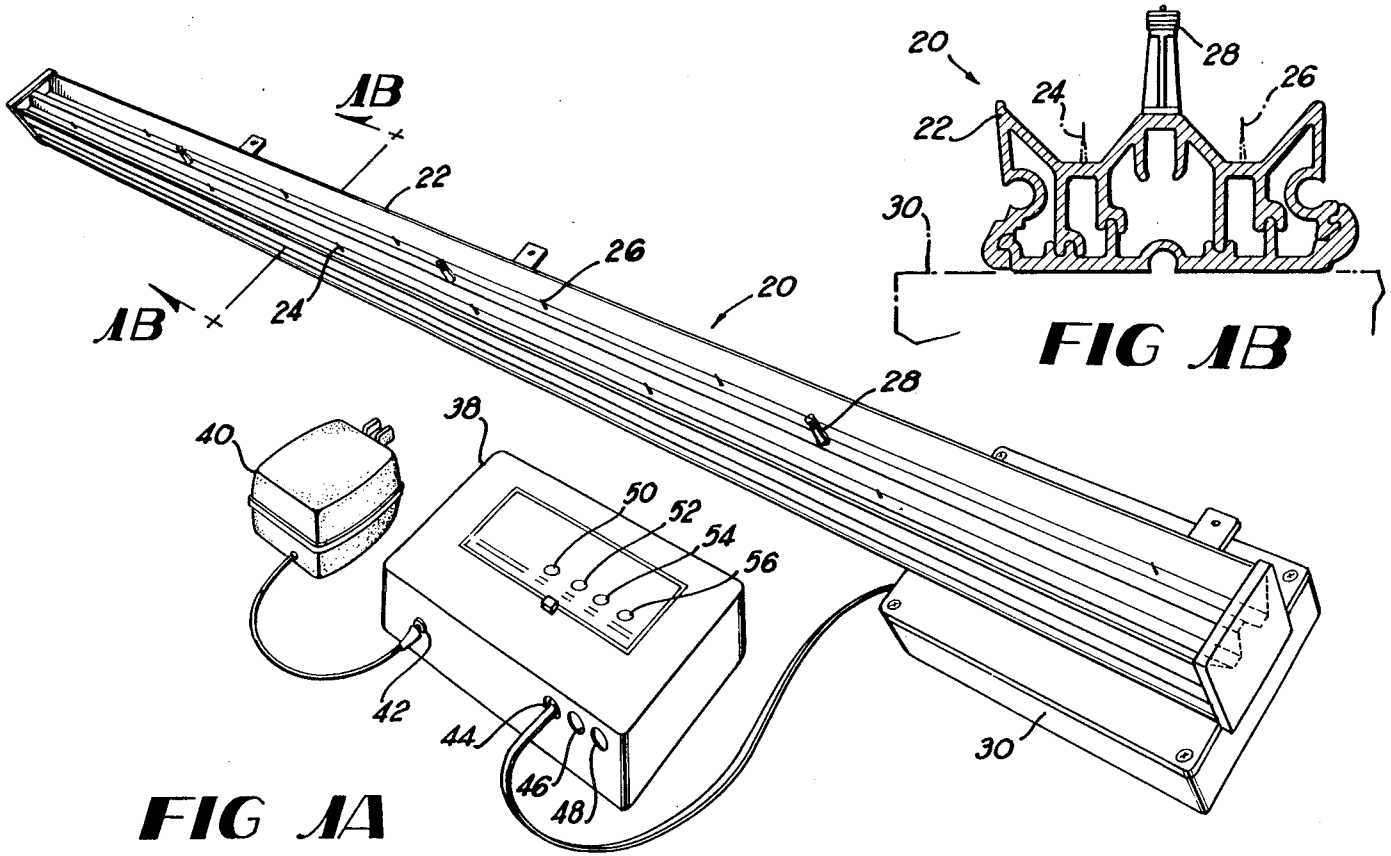
FIG. 1A is a perspective view of an emitter array according to the present invention.
FIG. 1B is a cross-sectional view of the array of FIG. 1A.

FIG. 1 shows an array 20 of a preferred embodiment of an area ionization system according to the present invention. Array 20 comprises generally an elongated rod 22 which supports positive emitters 24, negative emitters 26 and sensors 28. Rod 22 may be of any desired configuration. It is preferably of extruded plastic material having an essentially W-shaped cross section as shown in FIG. 2. A high voltage supply 30 is attached to rod 22 to energize positive emitters 24 and negative emitters 26. High voltage supply 30 comprises two circuits, a positive voltage supply 32 to feed positive emitters 24 and a negative voltage supply 34 to feed negative emitters 26. Positive voltage supply 32 is connected to positive emitters 24 via appropriate conductors, as is negative voltage supply 34 to negative emitters 26. Such conductors may be, for instance, appropriately insulated high-voltage wire.

Emitters 24 and 26 may be of thoriated tungsten, tungsten, purified or unpurified graphite, carbon or other appropriate material. Primary considerations for selection of materials for emitters 24 and 26 include durability and minimum production and attraction of foreign matter. The conventional material of choice is thoriated tungsten, but graphite may generate less foreign material. Buildup of such foreign material on emitters 24 and 26 degrades their ability to supply ions.

Spacing of emitters 24 and 26 has been found to be crucial. If the emitters are spaced too closely to one another, unacceptable ion migration and cancellation occurs between emitters of opposite polarity. Emitters spaced too distantly, on the other hand, cannot produce enough ions to supply the desired ionization levels. Emitters 24 are preferably spaced approximately twelve inches from each other, as are emitters 26, so that emitters 24 are spaced approximately six inches from emitters 26.

Sensors 28 are preferably spaced along the length of rod 22. Their number and distance from one another may be as desired. In the preferred embodiment, sensors 28 are positioned slightly closer to positive emitters 24 because positive ions are larger than negative ions and migrate more slowly to sensors 28. Ideally, this position is located at the net zero field point producing balanced positive and negative ion output. Sensors 28 may also be placed in the work area.

Sensors 28 may be coils of stainless steel wire or wire of other desired materials that are mounted in pylons of plastic or other desired material.

Arrays 20 may be positioned as desired in the area to be ionized. Such areas frequently incorporate moving "air curtains" which assist in ion transport. Arrays 20 are preferably spaced overhead in the area to be ionized. Arrays 20 may be independently controlled as channels, or they may be controlled hierarchically in zones of arrays 20, or according to any other desired scheme.

Advantageously, high voltage supplies 30 on arrays 20 of the present invention are fed by low voltage conductors 31 and 33. High voltage supplies 30 preferably provide between eight and twelve kilovolts at 1.5–2 microamps to emitters 24 and 26. The high voltage supply 30, however, requires only 10–24 volt power input. Accordingly, conductors 31 and 33 that connect the central control unit of the area ionization system of the present invention to the arrays 20 are low voltage conductors which create no high-voltage danger or other problems typically associated with high voltage conductors.

FIG. 1 shows a control unit for a first embodiment of the present invention in which analog circuits adjust voltage on emitters according to signals produced by sensors 28. Such circuit preferably maintains positive current supplied to positive emitters 24 constant while adjusting negative current supplied to negative emitters 26. The circuit could just as easily maintain negative current supply constant and adjust positive current supply. Negative ions migrate more easily, however, and adjustment of negative ion production accordingly causes a quicker and more efficient feedback process.

The control circuit 36 of the first embodiment of the present invention is located in a control unit 38 which is shown in FIG. 1. Unit 38 includes a low voltage power supply 40 connected to an input jack 42. The unit also features three output jacks 44, 46 and 48 which feed three channels of arrays 20. The face of control unit 38 features four light emitting diodes (LED,s) 50, 52, and 54 which correspond to the three channels, respectively, and a "service" LED 56 which tells the user when emitters 24 and/or 26 require cleaning or servicing because of degraded ion output or for other reasons.

Figure 2A:
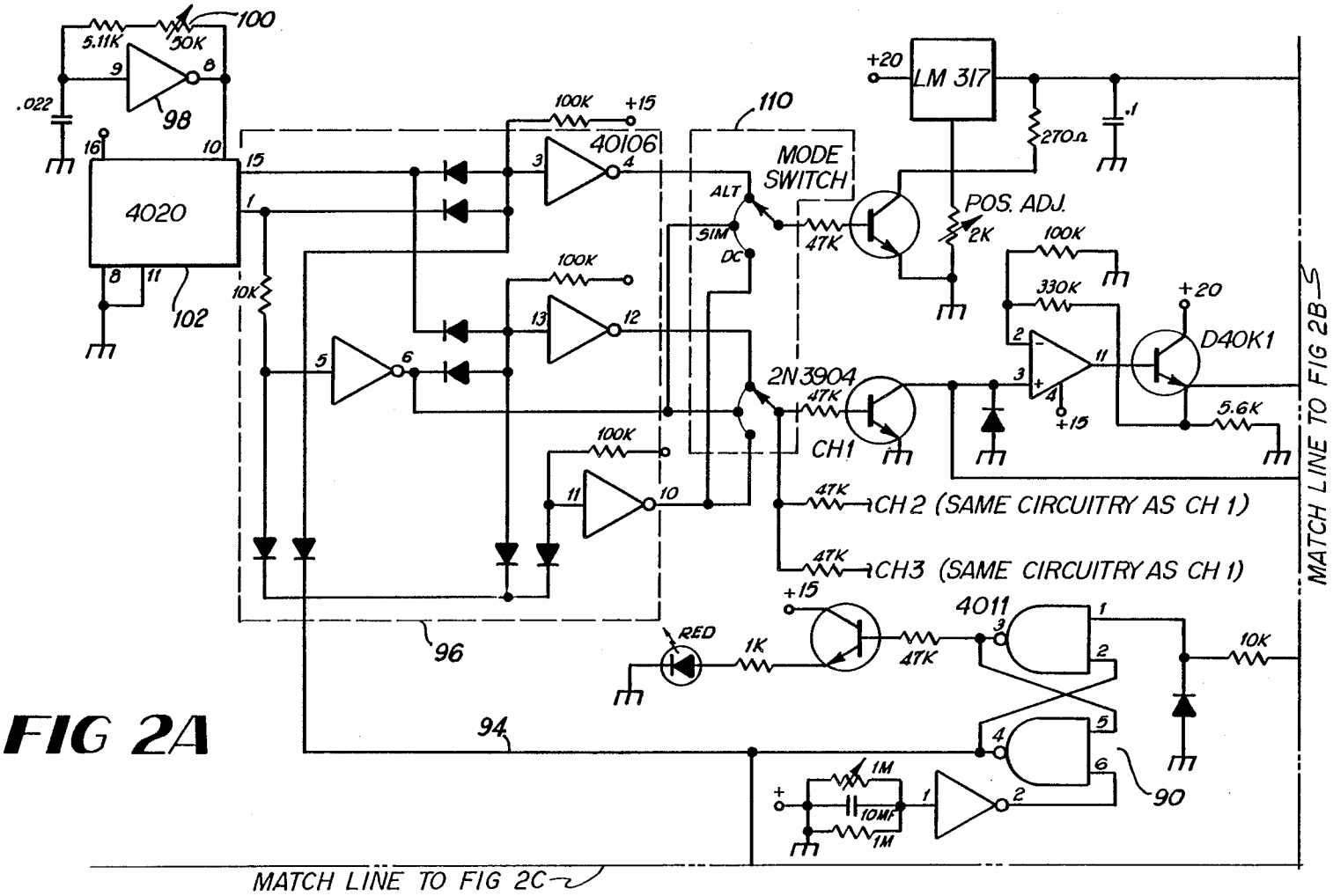
FIGS. 2A–D are schematic diagram of automatic control circuitry according to a first embodiment of the present invention.
Figure 2B:
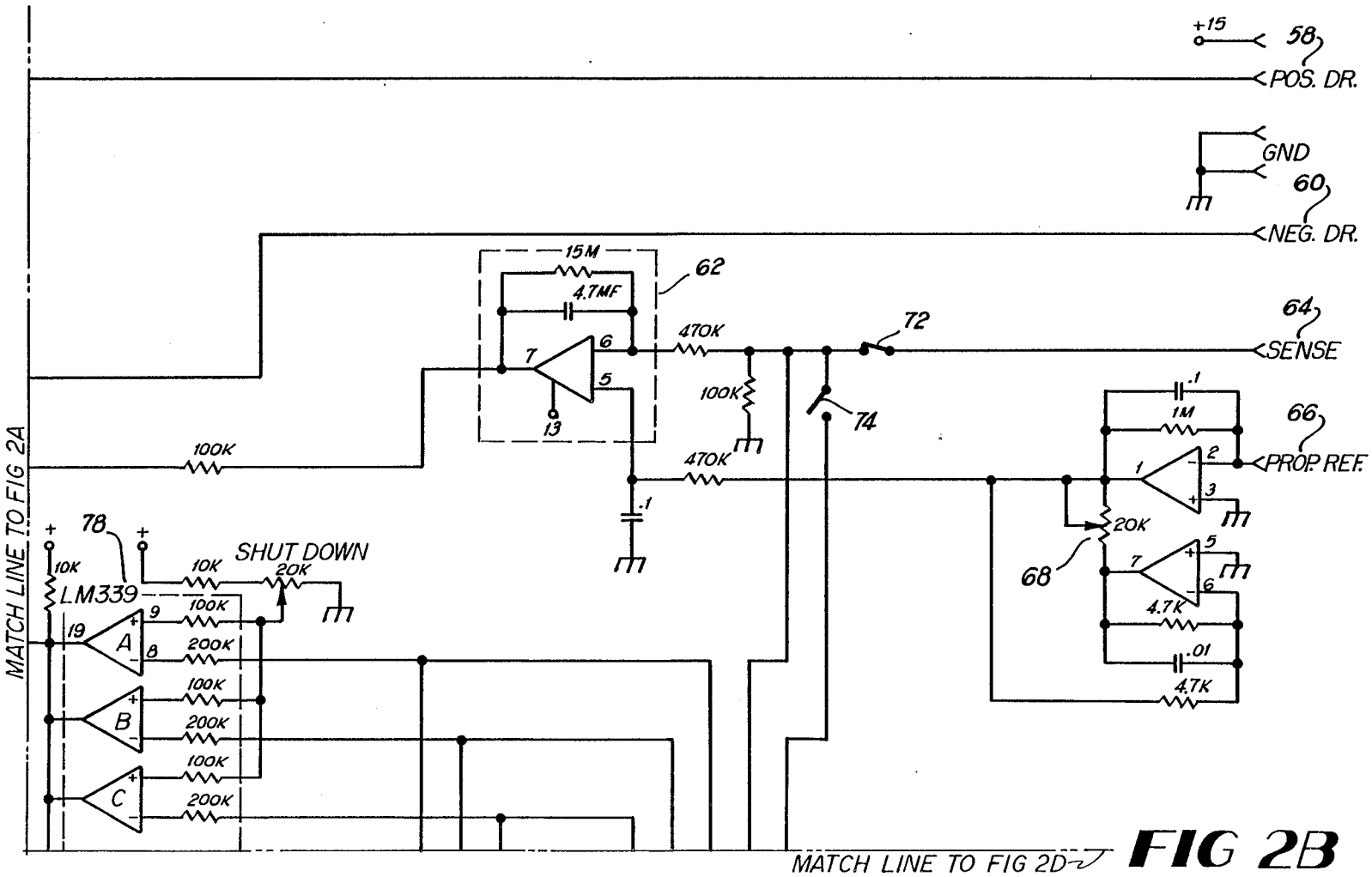
Figure 2C:
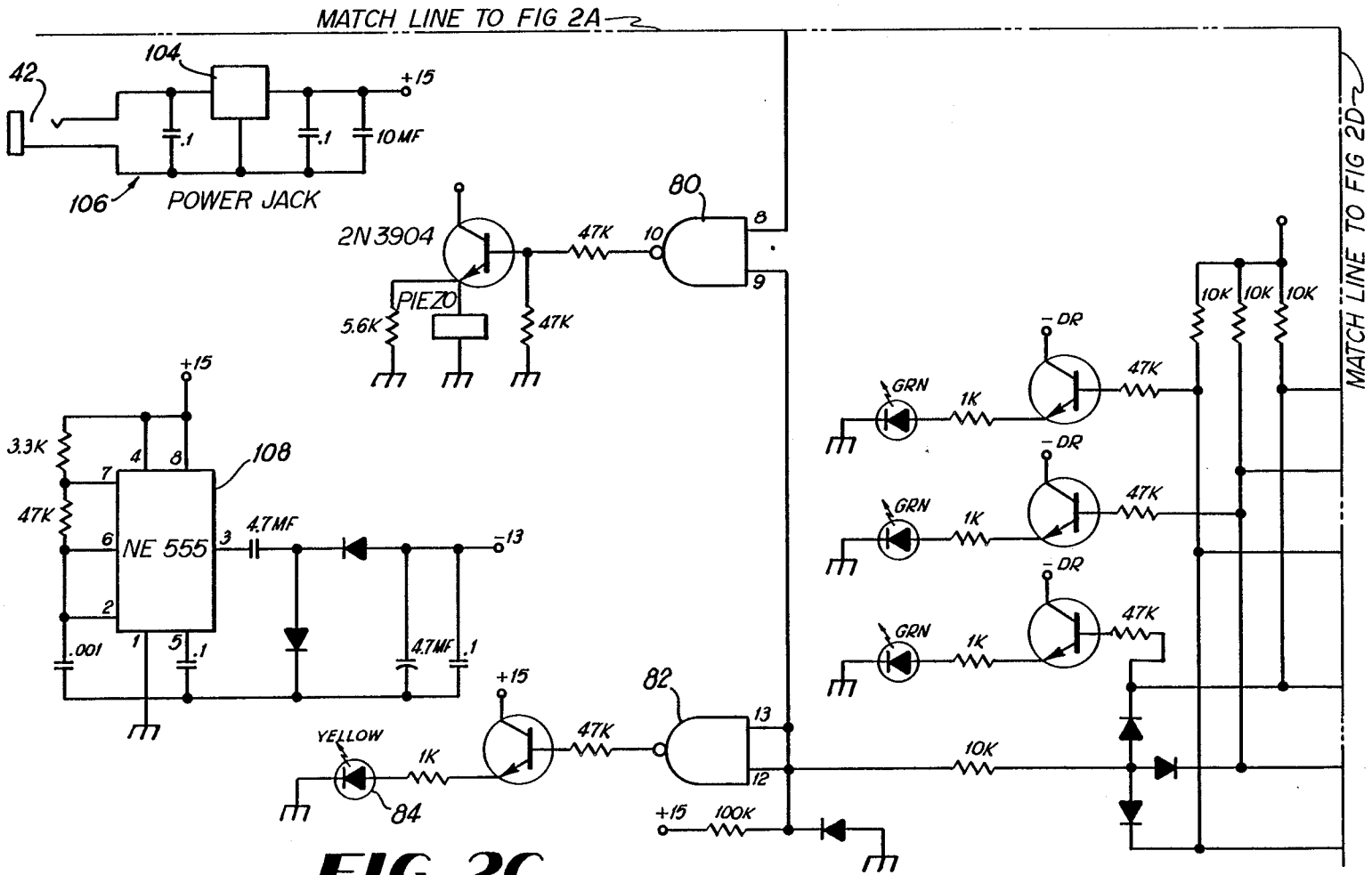

Control circuit 36 as shown in FIGS. 2A–D receives power from low voltage power supply 40 through input jack 42 and inputs from arrays 20 in order to control current supplied to emitters 24 and 26. Briefly, the "positive drive" signal 58 feeds positive voltage supply 32 in high voltage supply 30 on array 20. The positive drive signal 58 is preferably kept constant. The "negative drive" signal 60 feeds negative voltage supply 34 in high voltage supply 30 on array 20. A controlled emitter output as shown in FIG. 2B supplies negative drive 60. The emitter output is adjusted according to the output of a comparator 62 which receives a "sense" signal 64 on pin 6 from sensors 28 on arrays 20. Comparator 62 compares that signal to an input on pin 5 from a balancing circuit that receives the "proportional reference" signal 66 from high voltage supply 30. Proportional reference signal 66 represents the level of current that positive voltage supply 32 is supplying to positive emitters 24. Balancing potentiometer 68 allows the user to adjust the strength of the signal to pin 5 on comparator 62 and thus adjust the strength of the negative drive signal 60 in order to provide a greater or smaller supply of negative ions with respect to the number of positive ions being supplied by emitters 24 and 26, and thus to balance the ion supplies provided by those emitters.

Figure 2D:
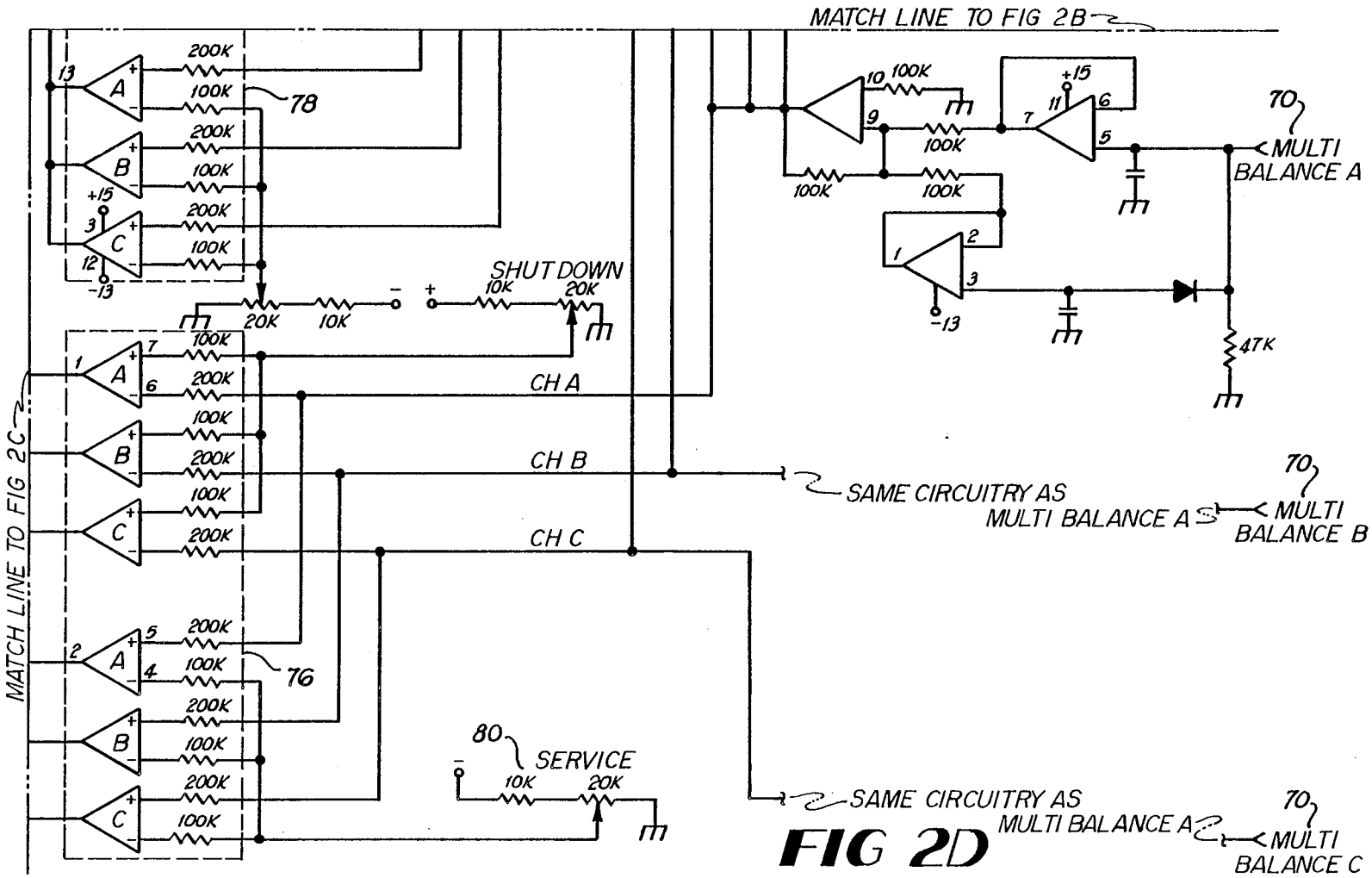

Multiplier balance signals 70 as shown in FIG. 2D correspond to each channel and originate in high voltage supply 30 on arrays 20. Multiplier balance signals 70 represent current level that high voltage supplies 30 are applying to emitters 24 and 26. Multiplier balance signals 70 rather than sense signals 64 provide feedback for the circuit 36 when the system operates in the AC mode to provide alternating current to the emitters.

When circuit 36 operates to control emitters 24 and 26 in the steady state DC or simultaneous pulse DC modes, switch 72 is closed and switch 74 is open so that feedback to the comparator 62 is in the form of sense signal 64. When circuit 36 operates in the alternating current mode, switch 72 opens and switch 74 closes so that multiplier balance signal 70 is applied to comparator 62 to control negative DC drive 60.

Sense signal 64, or when circuit 36 operates in the AC mode, multiplier balance signal 70, is also applied to service comparators 76 and shut down comparators 78. Service comparators 76 comprise six operational amplifiers (op-amps), a positive and negative op-amp for each of the three channels. Limits on each comparator may be set by setting service comparator potentiometer 80 in order to set the service limit beyond which the system will indicate that ionization provided by the system is out of tolerance and service is required.

Service comparators 76 actuate green LED's which indicate that ionization is within desired limits when service comparators 76 receive sense signal 64 or multiplier balance signal 70 that is within limits set into service comparator potentiometer 80. When such signals fall outside of those limits, service comparators 76 actuate a nand gate 82 which in turn actuates a yellow LED 84 to indicate that service is required to the system. The service comparators 76 additionally supply a signal to nand gate 86 in order to sound a piezoelectric buzzer when service is required.

Shut down comparators 78 likewise receive input in the form of negative drive signal 60 or multiplier balance signal 70. Shut down comparator potentiometer 88 allows the user to set limits at which comparators 78 will shut off current to the emitters. Shut down comparators 78 are connected to a flip flop 90 which activates red LED 92 when a multiplier balance signal 70 or negative drive signal 60 exceeds shut down potentiometer limits. Flip flop 90 also sends a shut down signal in such instance to shut down circuitry 96 in order to shut off positive drive 58 and negative drive 60 signals.

Schmitt trigger 90 with its associated feedback loop produces a square wave which is applied to 16-stage ripple counter 102 in order to supply power to circuit 36 for alternating current and simultaneous pulse DC modes. Rate control 100 in the feedback loop allows the user to control oscillation produced by the Schmitt trigger square wave oscillator. A 7815 voltage regulator 104 operates in power supply circuit 106 to supply 15 volts to circuit 36, and a free running oscillator with multiplier 108 supplies negative 13 volts to the op-amps.

Selection switch 110 allows the user to choose between steady state DC, simultaneous pulse DC, and alternating current modes of operation. A positive adjust potentiometer 112 allows the user to adjust independently positive drive levels 58 on each channel.

Figure 3:
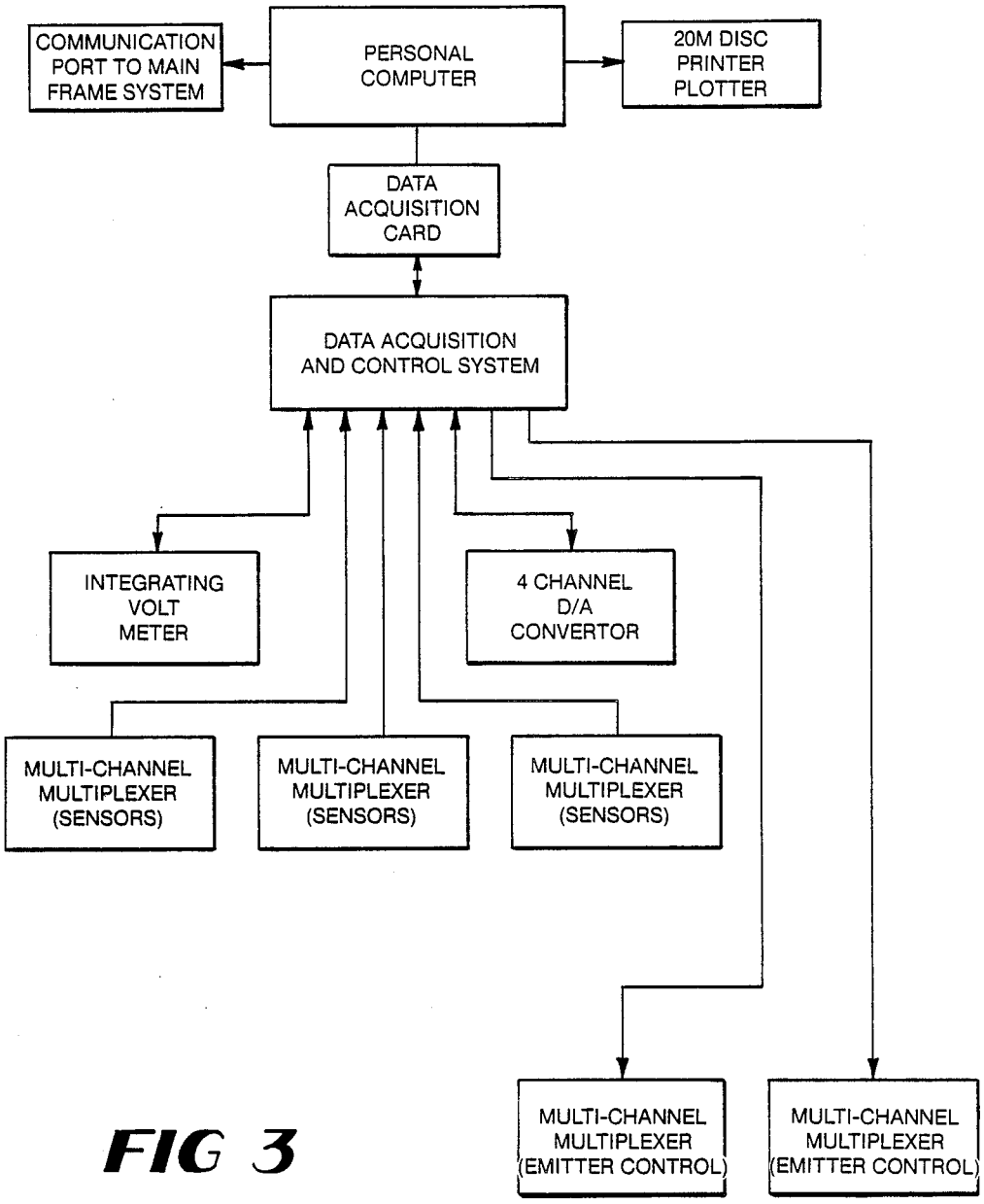
FIG. 3 is a block diagram of computer equipment for automatic control of area ion systems of the present invention.

FIG. 3 is a block diagram which shows components used for computerized monitoring and control of arrays 20. Computerized control system 112 comprises generally a data acquisition unit 114 or acquisition card connected to a plurality of sensors 116 which may include sensors 28, conductive wrist straps, footwear testers, current sensors, charge build-up monitors, tabletop ionizers, and temperature, humidity, air flow and ozone sensors. Data acquisition unit 114 is also connected to positive voltage supply 32 and negative voltage supply 34, designated as "emitters" in FIG. 3. A personal computer 118 with interface card may be connected to data acquisition unit 114 to process and store data acquired by acquisition unit 114. Computer 118 may also communicate to a mainframe computer via communication ports. Computer 118 may be connected to a printer or plotter 120 to plot information acquired by acquisition unit 114.

Data acquisition and control system 114 may be a Hewlett-Packard 3852 unit or any other desired unit and computer 118 may be a Hewlett-Packard Vectra, IBM compatible, or any other desired computer.

Figure 4:
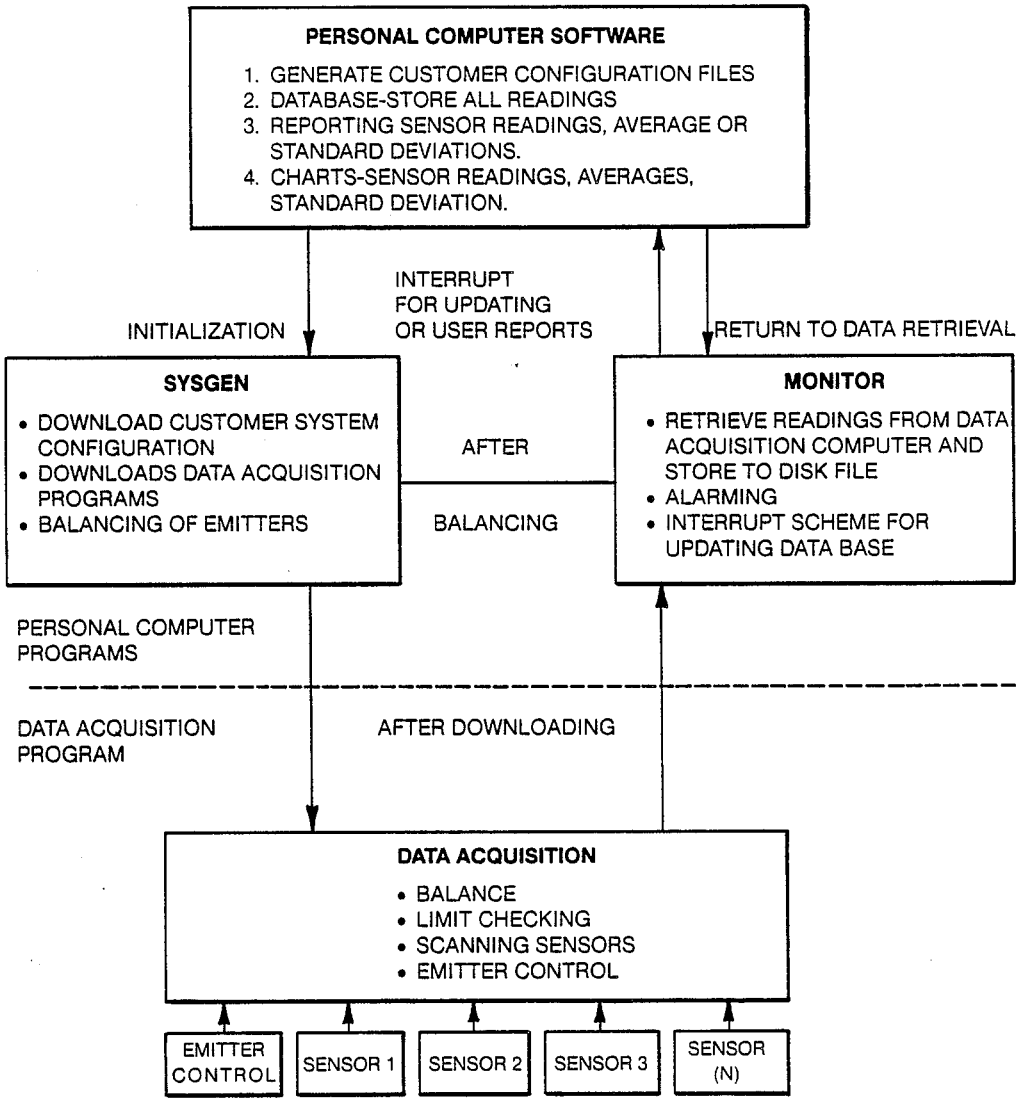
FIG. 4 is a program interaction diagram for computer programs for automatic control of area ionization systems according to the present invention.

FIG. 4 shows interaction of computer programs which can be used in connection with the equipment shown in FIG. 3 to control area ionization systems of the present invention. Briefly, personal computer data manager software, a "sysgen" program and a monitor program executed in computer 118 cooperate with data acquisition program executed in data acquisition unit 114 to control the system. The data manager software comprises conventional database management programs which accept the user's selection of ionization shut down and service monitoring levels, ion balance, positive voltage supplied to emitters 24 and 26 and desired ionization balance. The data manager program also receives, processes, stores, reports and charts information acquired and provided by data acquisition unit 114.

The sysgen program receives user configuration information, loads data acquisition programs into data acquisition unit 114 and controls balancing of emitters 24 and 26. After balancing is completed, the monitor program acquires information from data acquisition unit 114 and processes and stores that information in mass memory. The monitor program also actuates alarms which indicate when the area ionization system requires servicing or cannot re-balance as a result of ionization exceeding the limits programmed by the user. The data acquisition program controls the electrical power applied to emitters 24 and 26 and the balance of ionization provided by those emitters. The program also controls acquisition of information from the sensors.

The sysgen program is called by the data management program once the configuration files are generated. The sysgen program later calls the monitor program after ionization level has been balanced. The sysgen program initially loads the data acquisition program into acquisition unit 114 and sets the time on the computer 118 to correspond to the time on the data acquisition unit 114. The sysgen program then reads and stores the customer configuration information and determines how many channels of arrays 20 to monitor. It also organizes channels of arrays 20 according to zones within the area to be ionized in order to determine control timing of the zones and channels. The sysgen program then checks to insure that all desired zones are reflected.

The sysgen program sends three codes to the data acquisition unit 114 once it has checked the configuration files. The first two codes clear and reset the data acquisition unit 114 and the third sets a variable to hold the number of channels of arrays 20 connected to the system. A user defined time interval corresponds to each type of channel in the zones. Each channel type in the zone will be read once per interval by data acquisition unit 114, and readings for the channel types are spaced evenly in time.

The sysgen program initiates the data acquisition program in data acquisition unit 114, waits for balancing to complete and then calls the monitor program. During the waiting period the sysgen program also periodically interfaces with the data acquisition program to change power applied to emitters 24 and 26 in order to balance ionization created by the channels.

The monitor program coordinates with the data acquisition program and the data management program to handle information flow from the data acquisition unit 114 to the data management program. A first buffer in the data acquisition unit 114 and buffers in computer 118 allow storage of data in order to provide access by programs which could not otherwise access the data.

The monitor program initially reads the customer configuration files that the sysgen program is using in order to determine measurement intervals and limits consistent with those used by the sysgen program. The monitor program sends those limits to the data acquisition program.

The monitor program stores information acquired by data acquisition unit 114 for a predetermined period, typically 30 minutes, and the data management programs appends the information to the database. At the end of the 30-minute period, or a user interrupt request, the data management program determines whether the user has requested production of reports and graphs. The monitor program then clears the information in the disk file, which the data management program has already appended to the database and a buffer. At the end of the 30-minute period, the monitor program requests a storage count from the data acquisition program. The storage count is the number of readings in the data acquisition unit 114 buffer. The monitor program determines whether information was stored in the data acquisition unit 114 buffer since expiration of the previous period. If not, the monitor program deactivates until the end of the next period. The monitor program retrieves any additional information stored in the data acquisition unit 114 buffer and stores it in arrays before sending it to mass memory. The monitor program retrieves readings one at a time in order to avoid completely occupying the data acquisition program, which must simultaneously be taking readings from the sensors. The monitor program stores the information it retrieves in arrays in order to send it to mass media at one time and thus more quickly. The monitor program then checks the storage count once again, if it has retrieved information from the data acquisition unit 114, in order to ensure that no additional readings have been taken while the first batch was retrieved and stored to disk. If such information exists, the information is retrieved and stored to disk and the storage count is zeroed. If no such second batch of readings is detected, then the monitor program resets the storage count to zero and waits until the end of the next period.

The monitor program stores the sensed voltage level, the time of the reading in seconds after midnight, the channel number of the reading and the date as set on the computer 118.

The readings may also be displayed on computer screen in different colors to indicate when measurements are out of limits. For instance, voltage levels which exceed shutoff limits may be displayed in red while voltage limits which exceed service limits may be displayed in yellow while other values are displayed in green.

When the monitor program deactivates after taking its 30-minute readings, the data management program retrieves the data from disk and stores it to a final buffer.

The data management program presents initial menus which request information, including: type of sensors, zone of sensors, data acquisition unit 114 addresses for sensors, voltage high and low limits, measurement intervals, and scan time intervals, among other things.

Figure 5A:
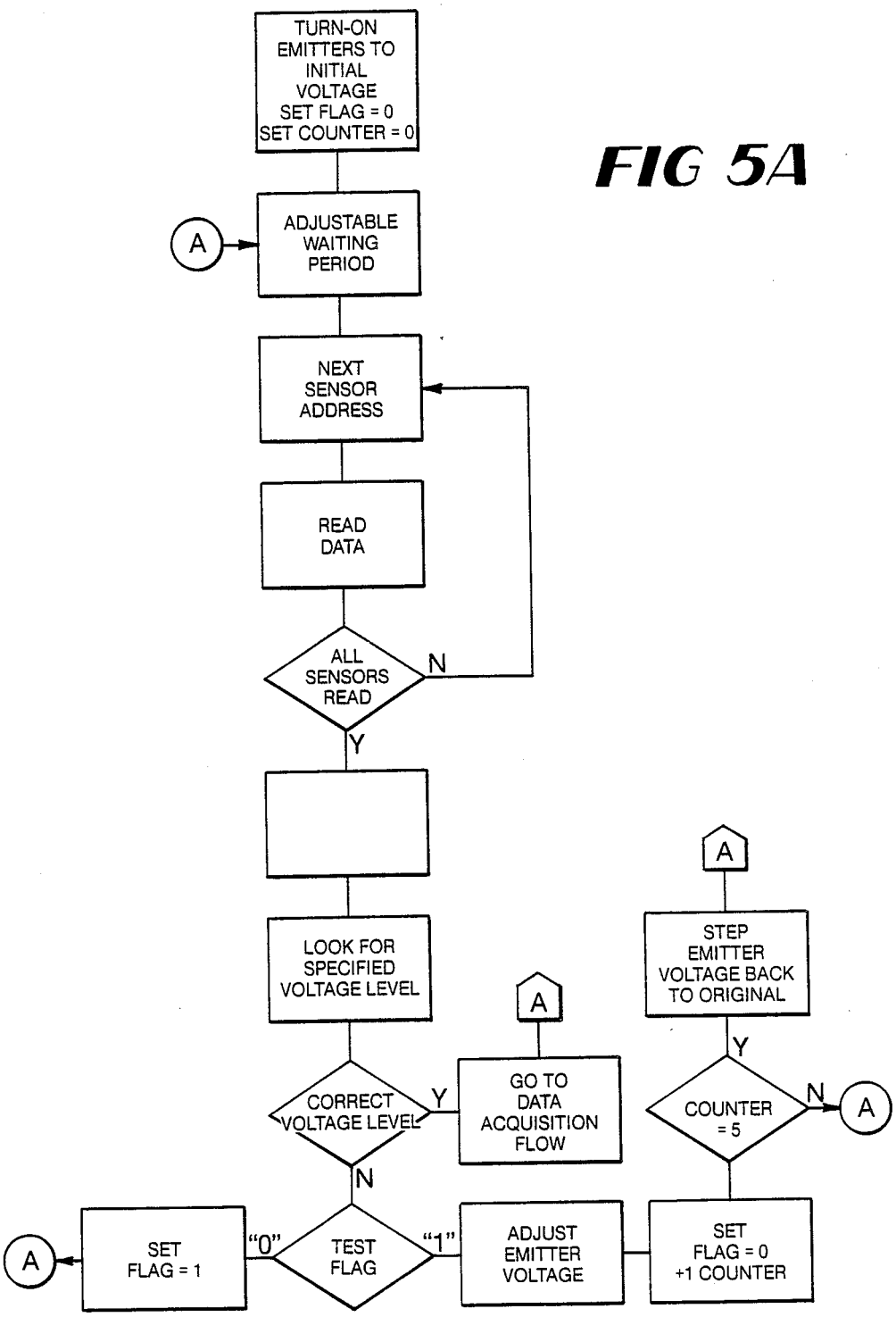
Figure 5B:
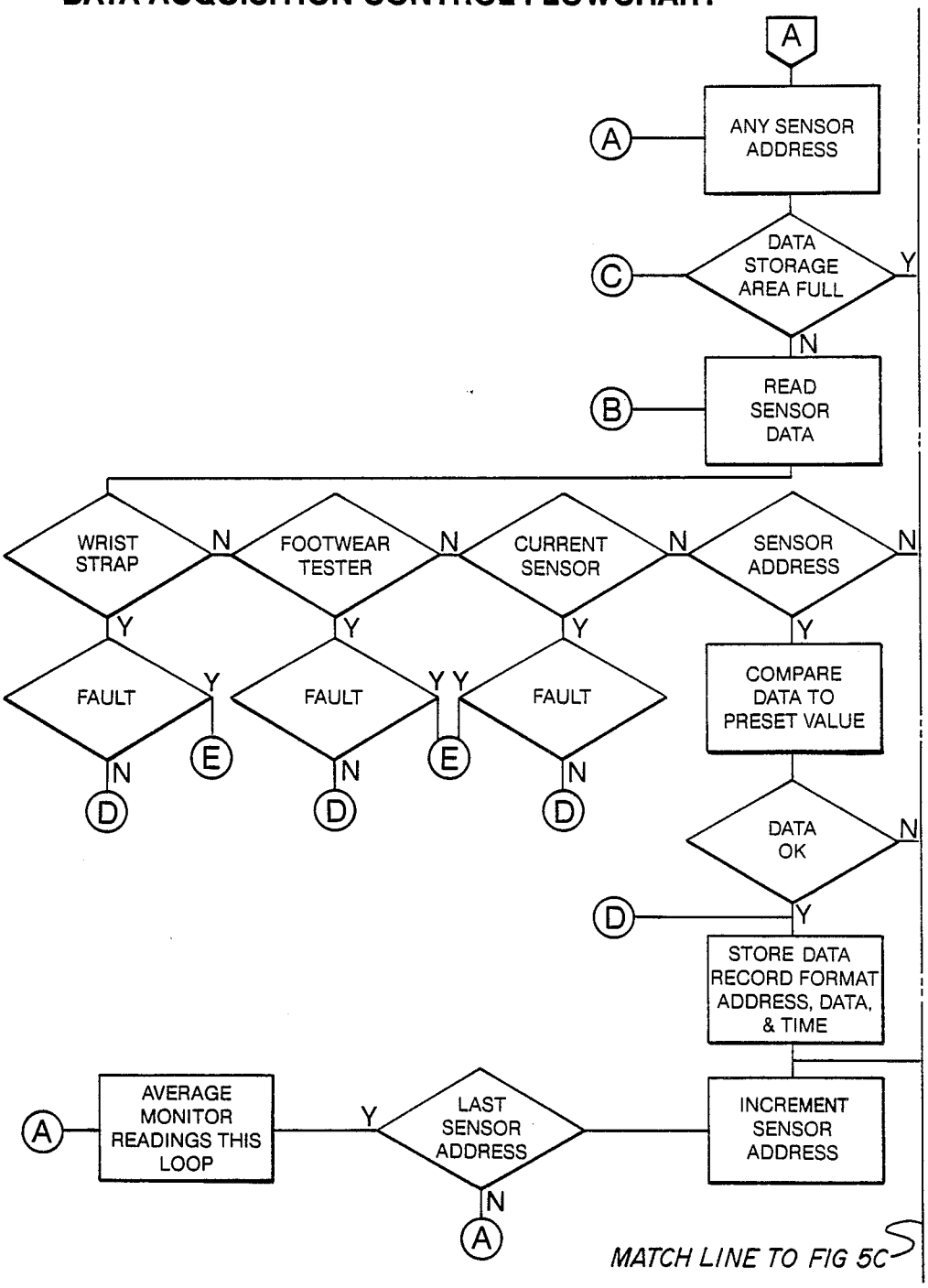
Figure 5C:
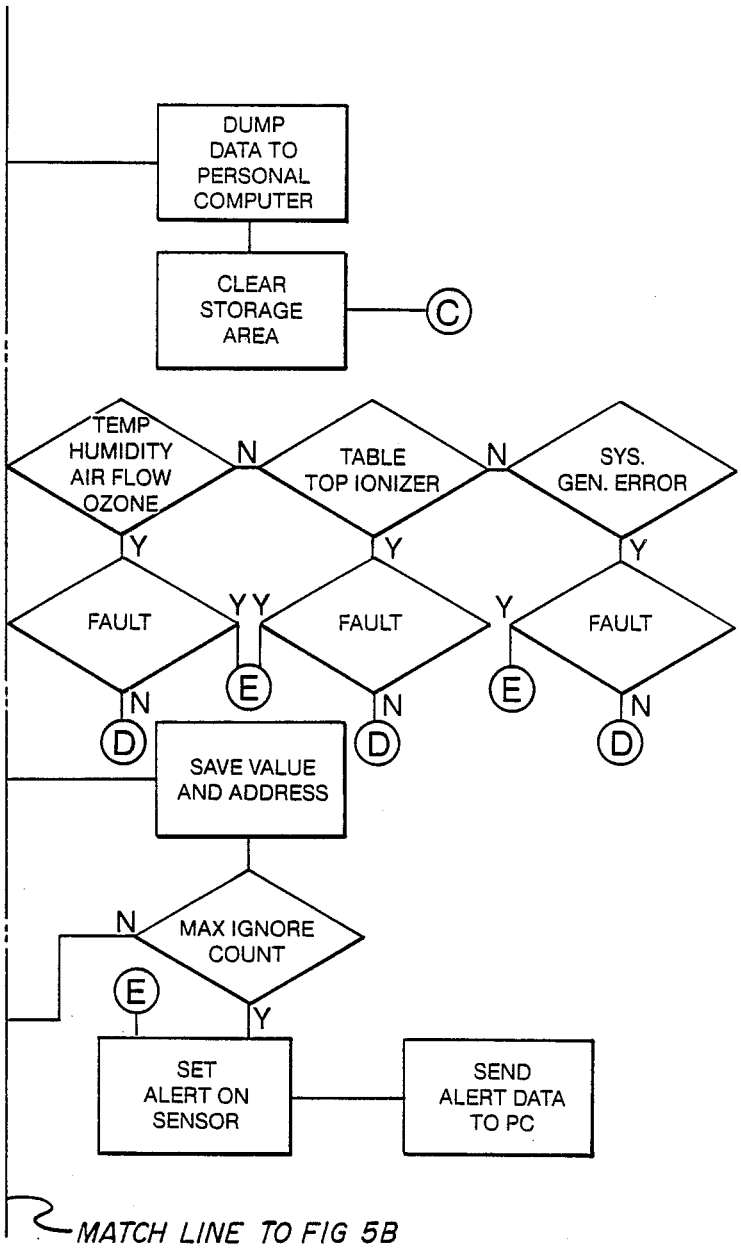
Figure 6A:
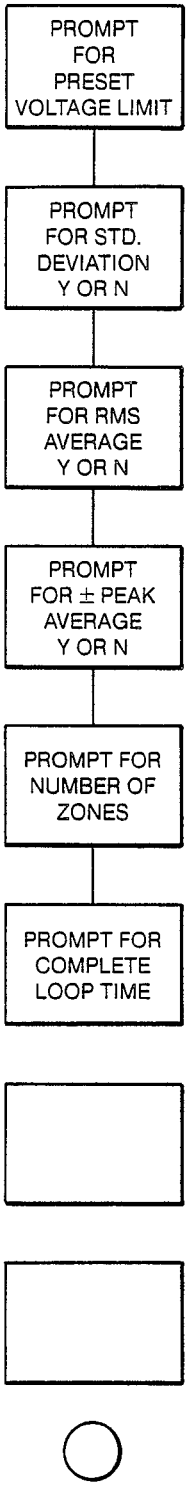
Figure 6B:
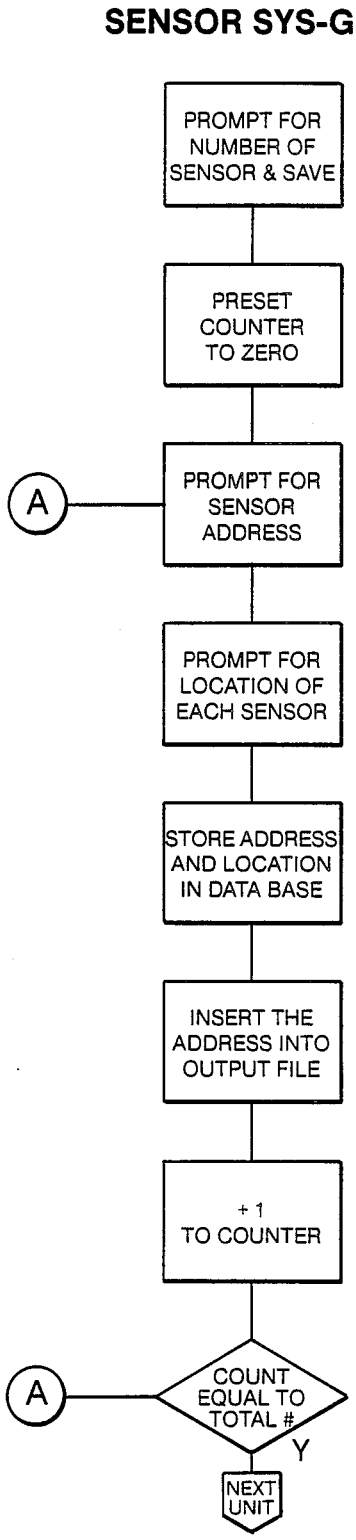
Figure 6C:
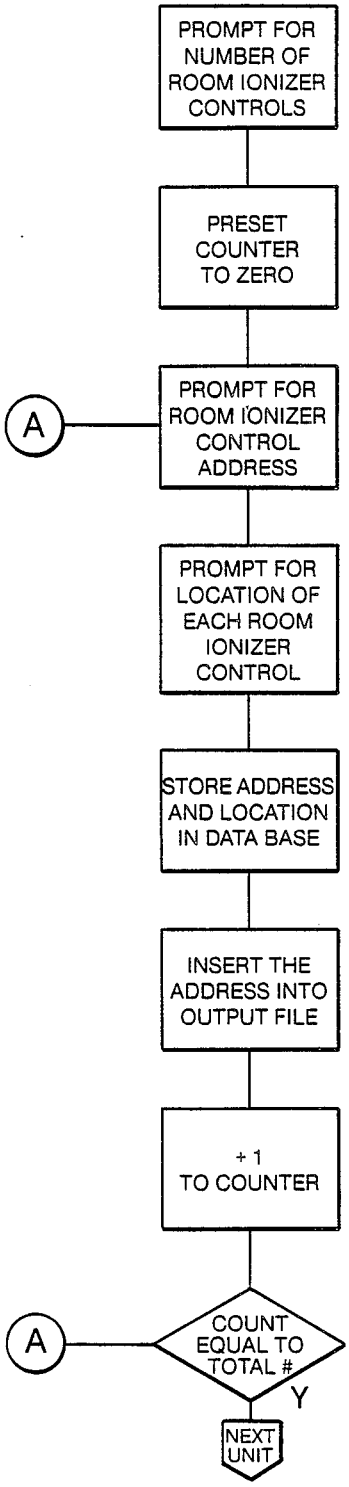
Figure 6D:
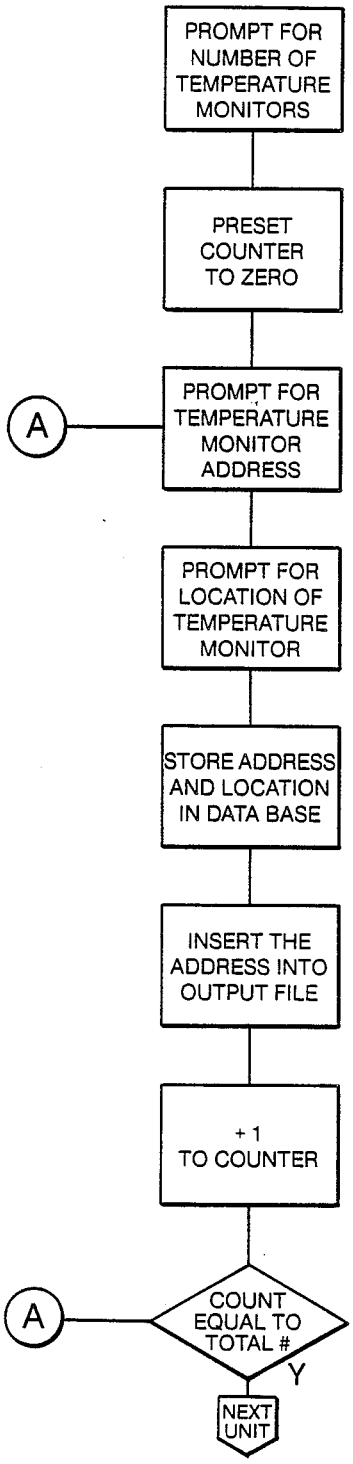
Figure 6E:
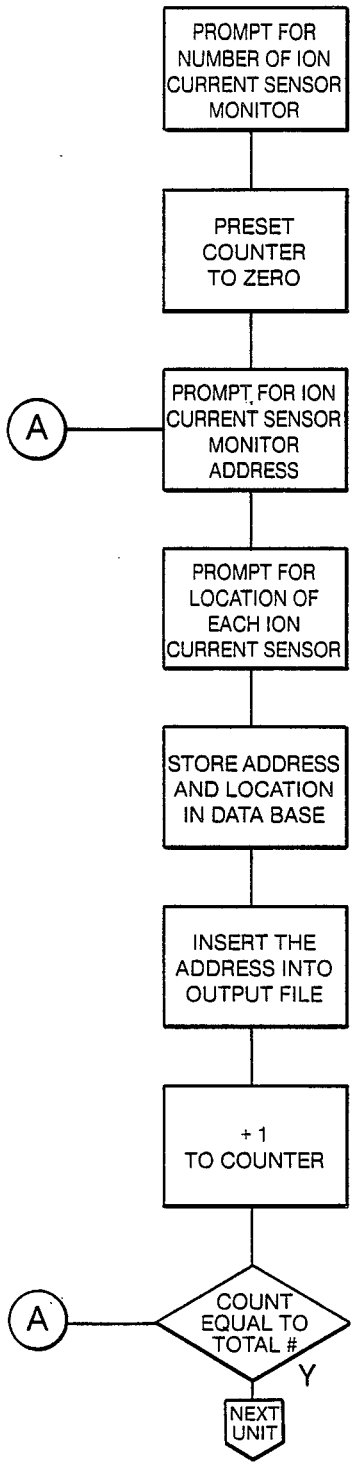
Figure 6F:
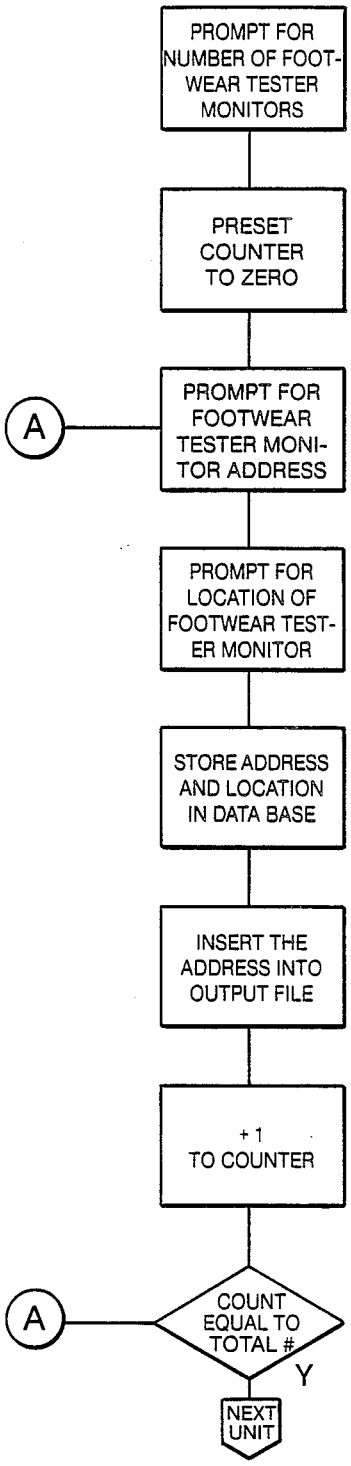
Figure 6G:
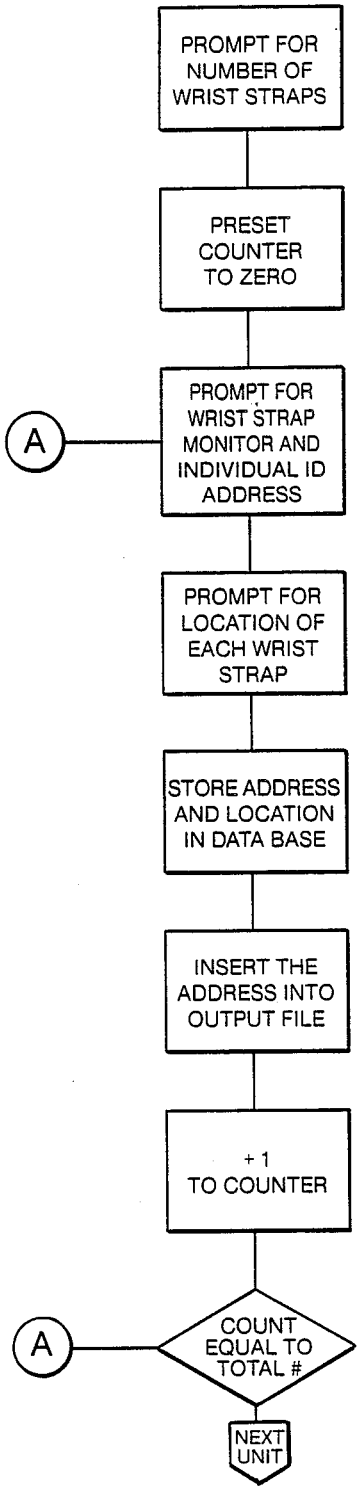
Figure 6H:
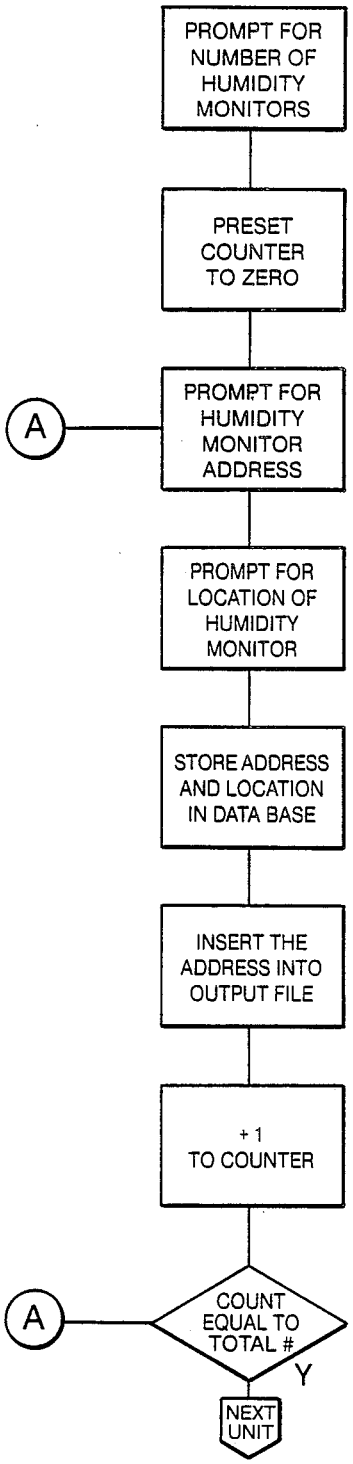
Figure 61:
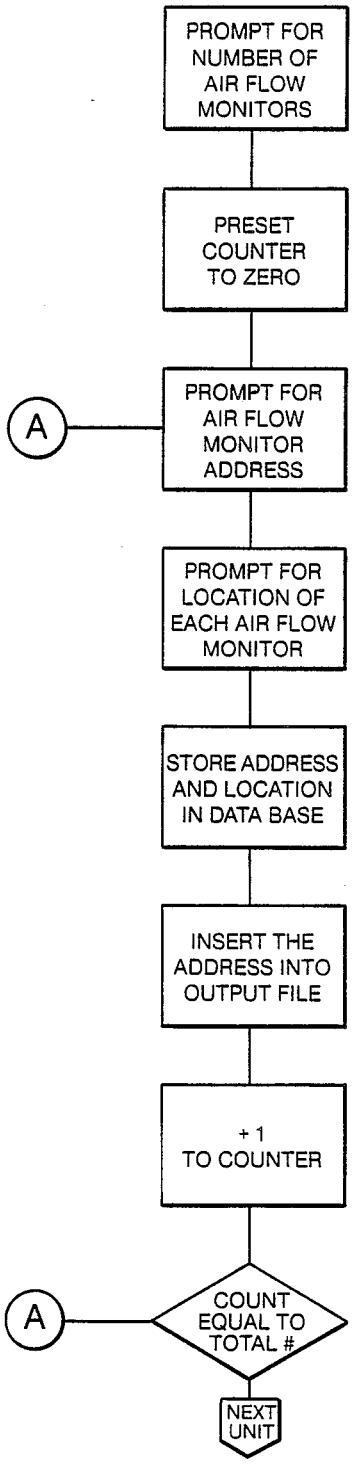
Figure 6J:
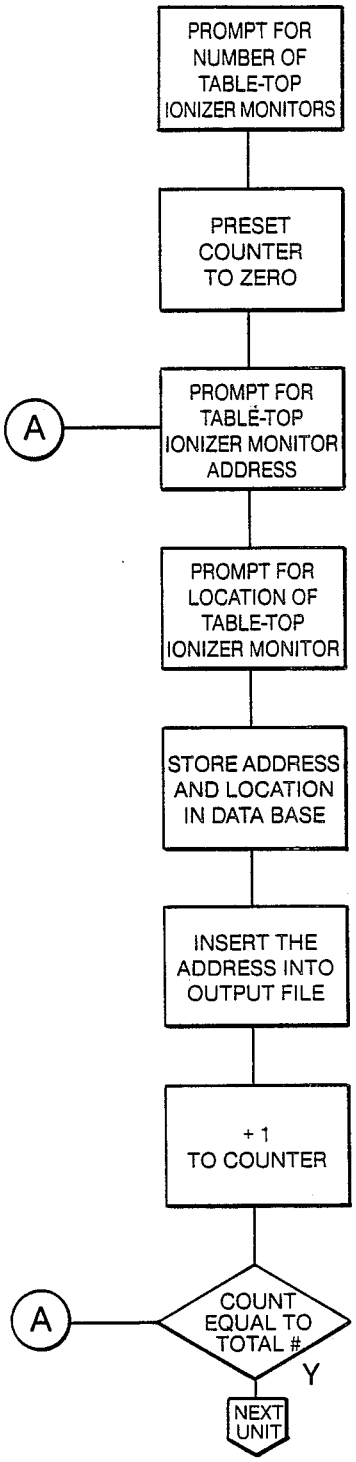
Figure 6K:
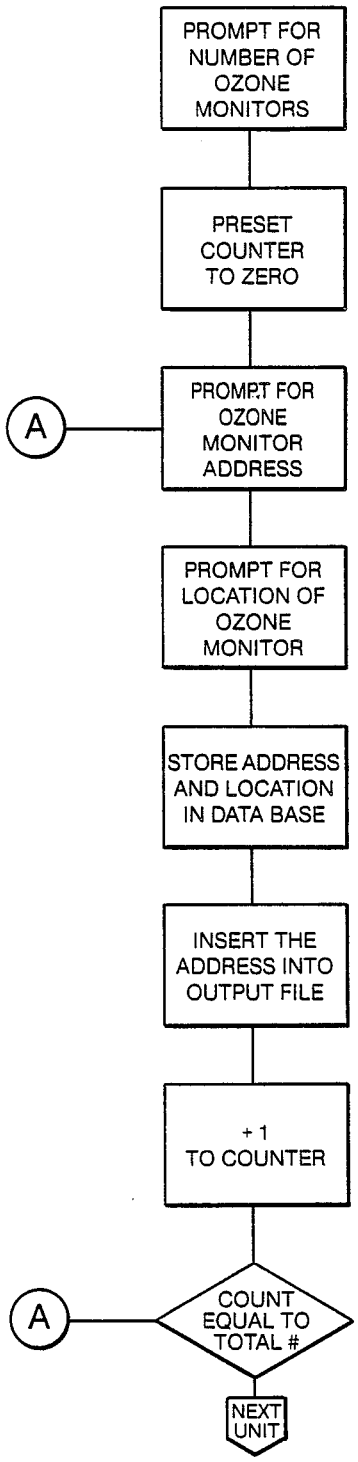

FIGS. 5A–5C show the balancing and monitoring steps performed by the programs. As shown in FIG. 5A, the emitters 24 and 26 are provided with initial voltage upon power up, and the system reads sensors 28 in emitter array 20 in order to determine whether voltage levels on those sensors are within the limits specified by the user. If they are, then the system transitions to the monitor mode as shown in FIGS. 5B and 5C. If not, a test flag is set to one and the read cycle repeats itself. If the voltage levels on the sensors 28 exceed the specified levels on the second pass, the program adjusts the voltage applied to the negative emitters 26, sets the test flag to zero and a counter to one. The sensors 28 are read until the counter reaches 5; at that time, the voltage applied to negative emitters 26 is returned to its original value. Audible alarms and screen reports are activated to alert for corrective action.

The monitor mode checks to determine whether the data storage area is full; if so, the data is dumped to computer 118 from data acquisition unit 114 and the buffer is cleared. The program then reads sensor data and compares charges on sensors 28 to preset values. If any data exceeds limits, its value and address is noted and the program sets the sensor to an alert state and sends an alarm signal to the computer 118. If the data falls within appropriate limits, it is stored and the sensor address is incremented until the last sensor address is reached, at which time the readings are averaged. If the averages of readings do not fall within appropriate limits, after three successive averages have been calculated, the monitor program will call sysgen program to reinstitute the re-balance procedure.

FIG. 6A–K shows steps the programs perform to obtain data from various sensors.

What is claimed is:

1. Apparatus for providing a supply of positive and negative ions to a work space, comprising:

(a) at least one array for mounting in the workspace which includes: -

(i) an elongated rod;

(ii) a set of positive emitters mounted on the rod and extending into the work space;

(iii) a set of negative emitters mounted on the rod and extending into the work space; and (iv) a high voltage power supply connected to the rod which contains a positive high voltage supply coupled to the positive emitters for providing continuous, positive direct current high voltage to the positive emitters and a negative high voltage supply coupled to the negative emitters for providing continuous, negative direct current high voltage to the negative emitters;

(b) a sensor for sensing presence of positive and negative ions and providing signals corresponding to such presence;

(c) a control means located remotely from the arrays for providing continuous, positive direct current low voltage to the positive high voltage supply and continuous, negative direct current low voltage to the negative high voltage supply, and coupled to the sensor for adjusting the level of low voltage supplied to the high voltage power supply in response to signals received from the sensor in order to produce a zero net field at the sensor; and (d) a pair of low voltage conductors, connecting the control means to the positive high voltage supply and to the negative high voltage supply.

2. Apparatus according to claim 1 further comprising means connected to the control means for storing and processing information related to ionization levels in the work space.

3. Apparatus according to claim 1 in which the control means further comprises means for deactivating the apparatus when a low voltage level supplied to the high voltage supply exceeds a limit preset in the controller.

4. Apparatus according to claim 1 in which the emitters are formed of thoriated tungsten.

5. Apparatus according to claim 1 in which the positive emitters are spaced approximately 12 inches from each other, the negative emitters are spaced approximately 12 inches form each other, and the positive emitters are spaced approximately 6 inches from the negative emitters.

6. Apparatus according to claim 1 in which the positive and negative direct current high voltage levels supplied to the emitters are between 8 and 12 kilovolts.

7. Apparatus according to claim 1 in which the sensor is formed of a coil of wire.

8. Apparatus according to claim 1 in which the sensor is formed of a coil of stainless steel wire.

9. Apparatus according to claim 1 in which the sensor is mounted closer to a positive emitter than to a negative emitter.

10. Apparatus according to claim 1 in which the positive and negative direct current low voltage levels supplies to the high voltage power supply are between 10 and 24 volts.

11. Apparatus according to claim 1 in which the control means adjusts the level of only one polarity of low voltage supplied to the high voltage power supply.

12. Apparatus according to claim 1 in which the control means adjusts the level of only the negative low voltage supplied to the high voltage power supply.

13. Apparatus according to claim 1 in which the control means further comprises indicators that indicate when ionization as sensed by the sensors is within desired limits.

14. Apparatus for providing a supply of positive and negative ions to a work space, comprising:

(a) at least one array for mounting in the workspace which includes:

(i) an elongated rod;

(ii) a set of positive emitters mounted on the rod, spaced approximately 12 inches from each other and extending into the work space;

(iii) a set of negative emitters mounted on the rod, spaced approximately 12 inches from each other and approximately 6 inches from the positive emitters and extending into the work space;

(iv) a high voltage power supply connected to the rod which contains a positive high voltage supply coupled to the positive emitters for providing continuous, positive direct current high voltage of between 8 and 12 kilovolts to the positive emitters and a negative high voltage supply coupled to the negative emitters for providing continuous, negative direct current high voltage of between 8 and 12 kilovolts to the negative emitters; and (v) a plurality of sensors mounted to the rod, closer to the positive emitters than to the negative emitters, for sensing presence of positive and negative ions and providing signals corresponding to such presence;

(b) a control means located remotely from the arrays for providing continuous, positive direct current low voltage of between 10 and 24 volts tot he positive high voltage supply and continuous, negative direct current low voltage of between 10 and 24 volts to the negative high voltage supply, and coupled to the sensors for adjusting the level of negative low voltage supplied to the high voltage power supply in response to signals received from the sensors in order to produce a zero net field at the sensors; and (c) a pair of low voltage conductors, connecting the control means to the positive high voltage supply and to the negative high voltage supply.

15. Apparatus according to claim 14 further comprising means connected to the control means for storing, processing and displaying information related to ionization levels in the work space.

16. Apparatus according to claim 14 in which the control means further comprises means for deactivating the apparatus when a low voltage level supplied to the high voltage supply exceeds a limit preset in the controller.

17. Apparatus according to claim 14 in which the emitters are formed of thoriated tungsten.

18. Apparatus according to claim 14 in which the sensors are formed of coils of wire.

19. Apparatus according to claim 14 in which the sensors are formed of coils of stainless steel wire.

20. Apparatus according to claim 14 in which the control means further comprises indicators that indicate when ionization as sensed by the sensors is within desired limits.

* * * * *